US010847301B2

(12) United States Patent
Aoki et al.

(10) Patent No.: US 10,847,301 B2
(45) Date of Patent: Nov. 24, 2020

(54) ELECTRONIC COMPONENT

(71) Applicant: TDK CORPORATION, Tokyo (JP)

(72) Inventors: Shunji Aoki, Tokyo (JP); Yuya Ishima, Tokyo (JP); Masaki Takahashi, Tokyo (JP); Yuki Okazaki, Yuri-Honjo (JP); Takeshi Sasaki, Yuri-Honjo (JP)

(73) Assignee: TDK CORPORATION, Tokyo (JP)

( * ) Notice: Subject to any disclaimer, the term of this patent is extended or adjusted under 35 U.S.C. 154(b) by 166 days.

(21) Appl. No.: 15/937,313

(22) Filed: Mar. 27, 2018

(65) Prior Publication Data

US 2018/0286565 A1 Oct. 4, 2018

(30) Foreign Application Priority Data

Mar. 30, 2017 (JP) ..... 2017-067453

(51) Int. Cl.
*H01F 5/00* (2006.01)
*H01F 27/28* (2006.01)
*H01F 41/04* (2006.01)

(52) U.S. Cl.
CPC ..... *H01F 27/2804* (2013.01); *H01F 41/043* (2013.01); *H01F 2027/2809* (2013.01)

(58) Field of Classification Search
CPC ..... H01F 41/043; H01F 2027/2809
USPC ..... 336/200
See application file for complete search history.

(56) References Cited

U.S. PATENT DOCUMENTS

| | | | | |
|---|---|---|---|---|
| 6,159,768 | A * | 12/2000 | Ahn | H01C 13/02 438/107 |
| 9,984,805 | B2 * | 5/2018 | Kudo | H01F 17/0013 |
| 10,236,112 | B2 * | 3/2019 | Jung | H01F 27/29 |
| 2007/0224400 | A1 | 9/2007 | Meguro et al. | |
| 2013/0187744 | A1 | 7/2013 | Seko et al. | |
| 2015/0009003 | A1 | 1/2015 | Ozawa et al. | |
| 2016/0012957 | A1 * | 1/2016 | Lim | H01F 17/0013 336/200 |
| 2017/0018361 | A1 * | 1/2017 | Nishisaka | H01G 4/2325 |
| 2017/0103846 | A1 | 4/2017 | Yoneda | |
| 2017/0271081 | A1 | 9/2017 | Maki et al. | |

FOREIGN PATENT DOCUMENTS

| | | | |
|---|---|---|---|
| CN | 101129102 | A | 2/2008 |
| CN | 103219129 | A | 7/2013 |
| JP | H11-340089 | A | 12/1999 |
| JP | 5888289 | B2 | 3/2016 |
| TW | 201637039 | A | 10/2016 |
| WO | 2016/006542 | A1 | 1/2016 |

* cited by examiner

*Primary Examiner* — Ronald Hinson
(74) *Attorney, Agent, or Firm* — Oliff PLC

(57) ABSTRACT

An electronic component includes an element body, a conductor provided on the element body, a plating layer provided on the conductor, and a glass layer provided on the conductor along an outer edge of the plating layer.

11 Claims, 5 Drawing Sheets

ELECTRONIC COMPONENT

TECHNICAL FIELD

One aspect of the present invention relates to an electronic component.

BACKGROUND

Japanese Patent No. 5888289 discloses an electronic component including a laminate, an external electrode, an Ni plating layer and an Sn plating layer. The external electrode is embedded in the bottom face and the end face of the laminate. The Ni plating layer and the Sn plating layer are provided at a portion where the external electrode is exposed from the laminate. In this electronic component, by setting the thicknesses of the Ni plating layer and the Sn plating layer within a predetermined range, cracking and chipping in the laminate is suppressed.

SUMMARY

In the above electronic component, a phenomenon (plating elongation) in which a plating layer is formed not only on the external electrode but also on the laminate sometimes occurs. In such a case, when the electronic component is mounted on another electronic device by, for example, solder joint, a short circuit between conductors can occur.

One aspect of the present invention is to provide an electronic component in which plating elongation is suppressed.

An electronic component according to one aspect of the present invention includes an element body, a conductor provided on the element body, a plating layer provided on the conductor, and a glass layer provided on the conductor along an outer edge of the plating layer.

In this electronic component, since the glass layer is provided on the conductor along the outer edge of the plating layer, plating elongation is suppressed.

In the electronic component according to the aspect of the present invention, in the conductor, a width of a region at which the glass layer is provided may be equal to or greater than a thickness of the plating layer. In this case, plating elongation is reliably suppressed.

In the electronic component according to the aspect of the present invention, the plating layer is provided on the glass layer. In this case, the plating layer is provided in a wide range. Thus, when the electronic component is mounted on another electronic device, the electronic component can be stably mounted, and mountability is improved.

In the electronic component according to the aspect of the present invention, the element body contains a glass component, and the glass layer includes the same component as the glass component. In this case, the possibility that the component of the glass layer adversely affects the characteristics of the electronic component can be reduced as compared with the case in which the glass layer includes a glass component that is not contained in the element body.

In the electronic component according to the aspect of the present invention, the element body may be provided with a recess, and the conductor may be disposed in the recess. In this case, the distance between the upper face of the conductor and an outer surface of the element body is shortened as compared with the case in which the conductor is provided on the outer surface of the element body. Thus, when the glass layer is formed on the conductor because the glass component of the element body reaches the upper face of the conductor at the time of obtaining an intermediate body including the element body and the conductor by, for example, heat treatment, the glass component of the element body easily reaches the upper face of the conductor. As a result, it is possible to easily form the glass layer on the conductor.

In the electronic component according to the aspect of the present invention, the element body may have a mounting surface, and the conductor may have a first conductor portion disposed on the mounting surface. In this case, when the electronic component is mounted on another electronic device, it is possible to easily achieve the electrical connection between the first conductor portion and the electronic device.

In the electronic component according to the aspect of the present invention, the element body may further have an end face continuing from the mounting surface, the conductor may further have a second conductor portion disposed on the end face and have an L-shaped cross section. The second conductor portion may be provided integrally with the first conductor portion. In this case, when the electronic component is mounted on another electronic device by, for example, solder joint, solder is provided not only on the mounting surface but also on the end face. Accordingly, it is possible to increase mounting strength.

DETAILED DESCRIPTION

Hereinafter, an embodiment will be described in detail with reference to the accompanying drawings. In the following description, the same reference sign is assigned to the same element or the element having the same function, and the redundant description will be omitted.

Figure 1:
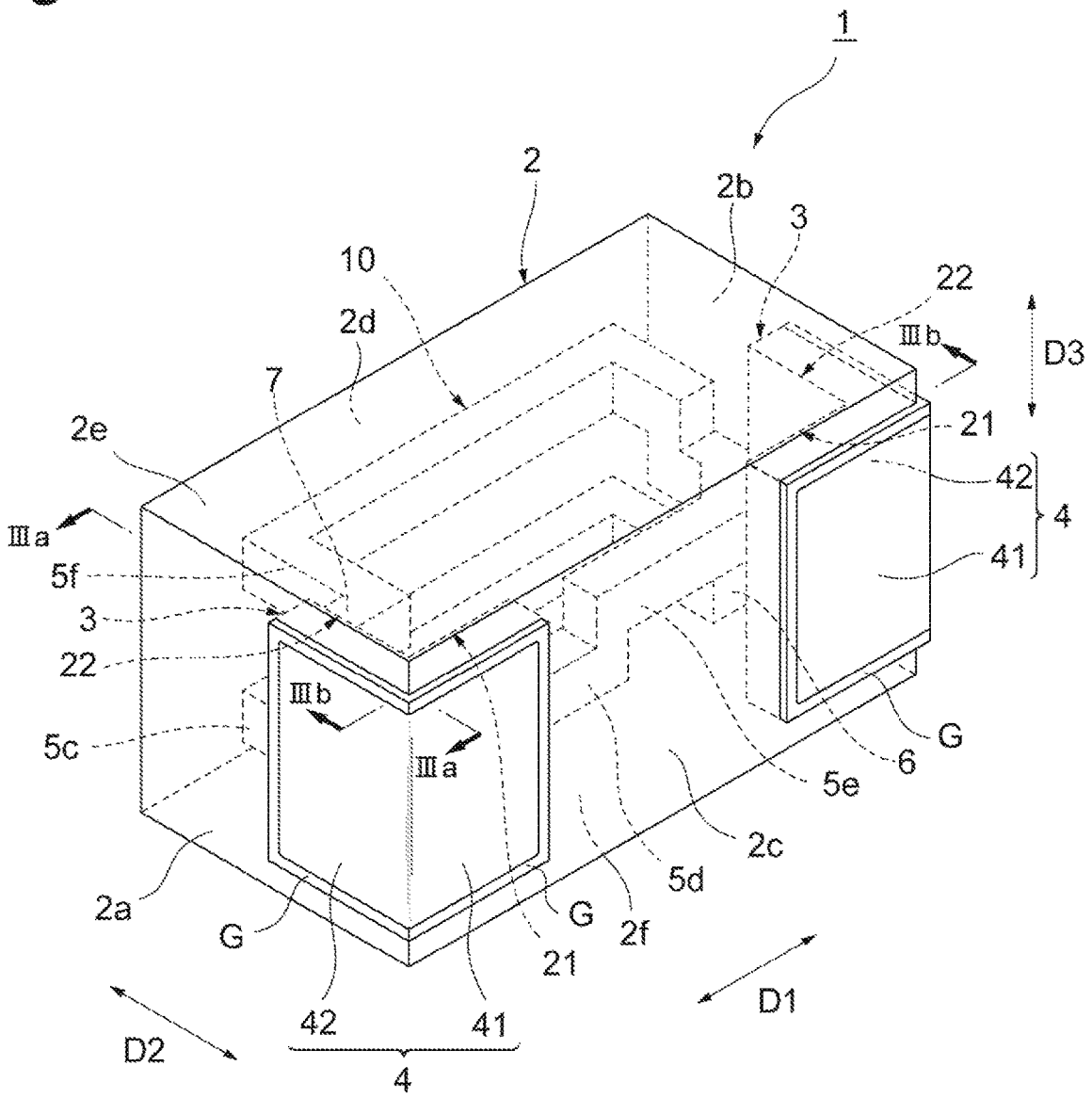
FIG. 1 is a perspective view of a laminated coil component according to an embodiment.
Figure 2:
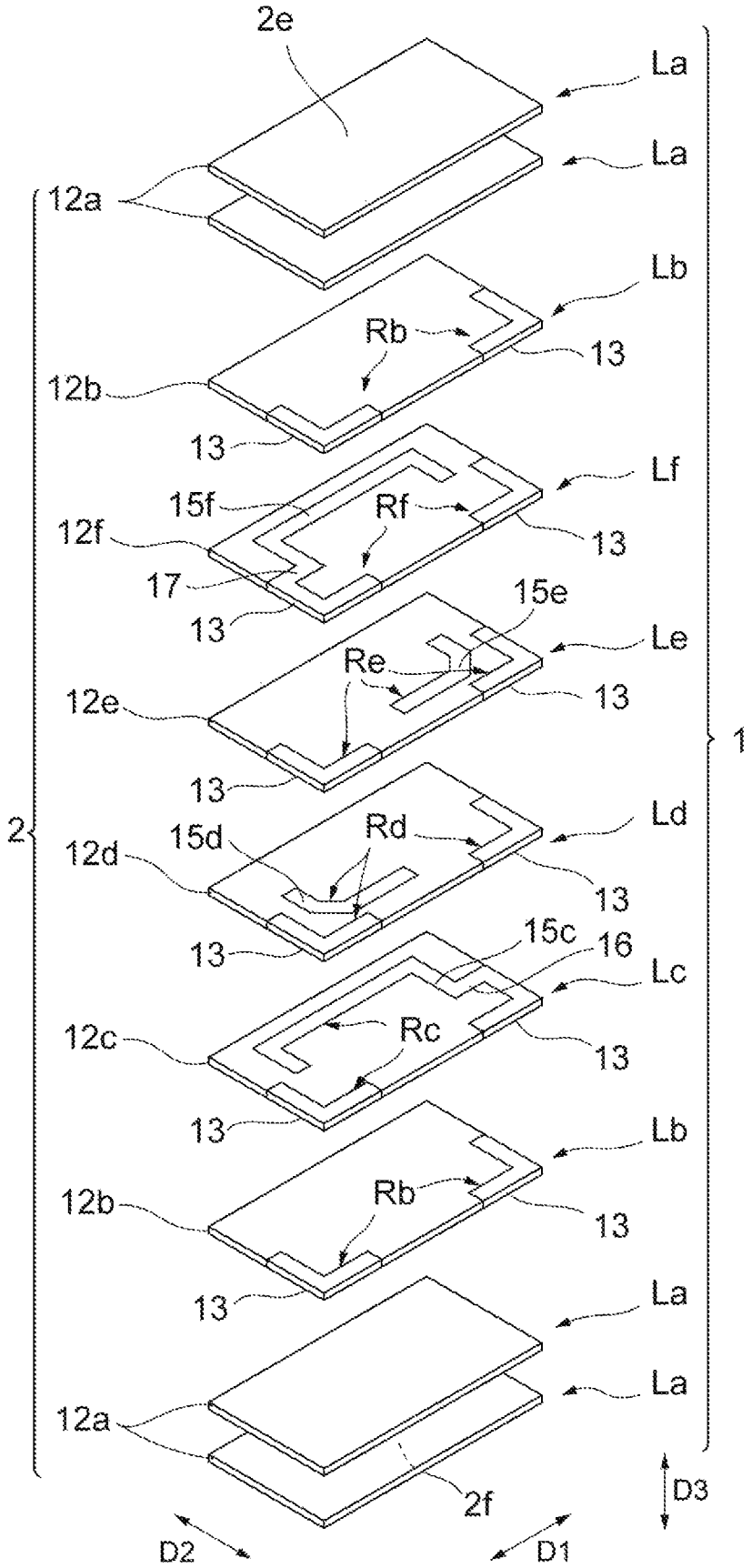
FIG. 2 is an exploded perspective view of the laminated coil component in FIG. 1.
Figure 3A:
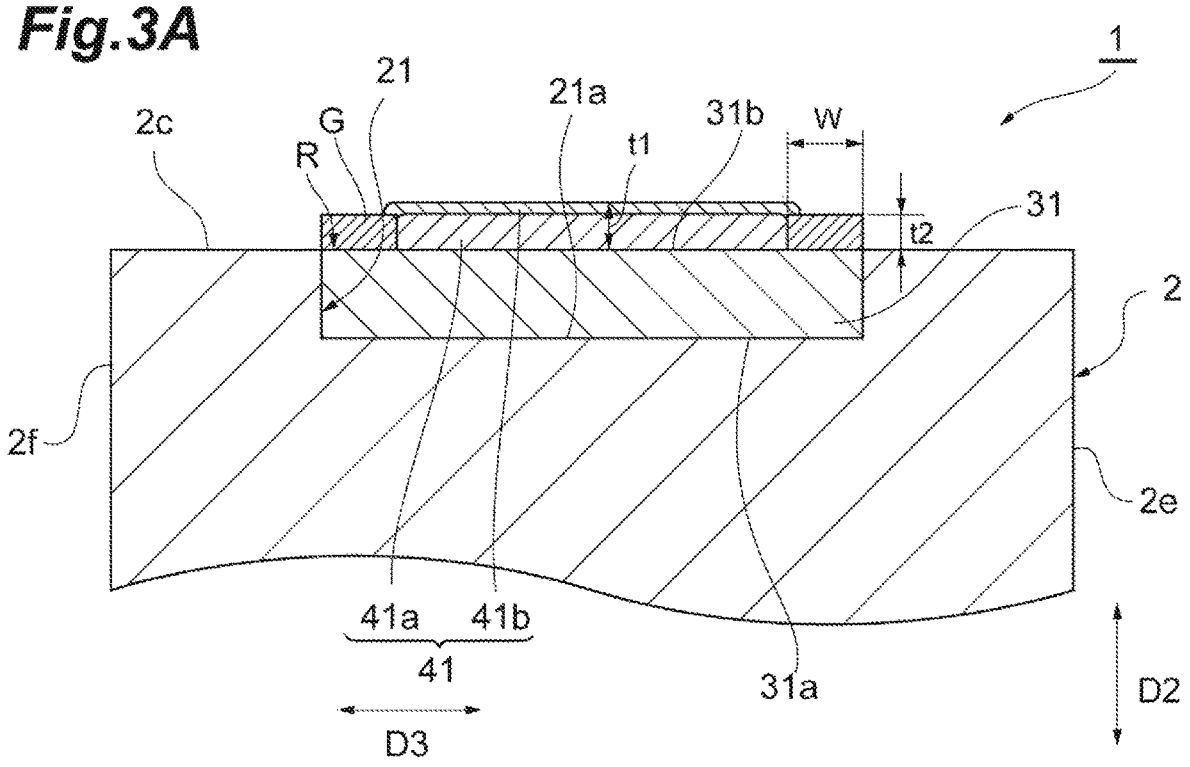
FIGS. 3A and 3B are cross-sectional views of the laminated coil component in FIG. 1.
Figure 3B:
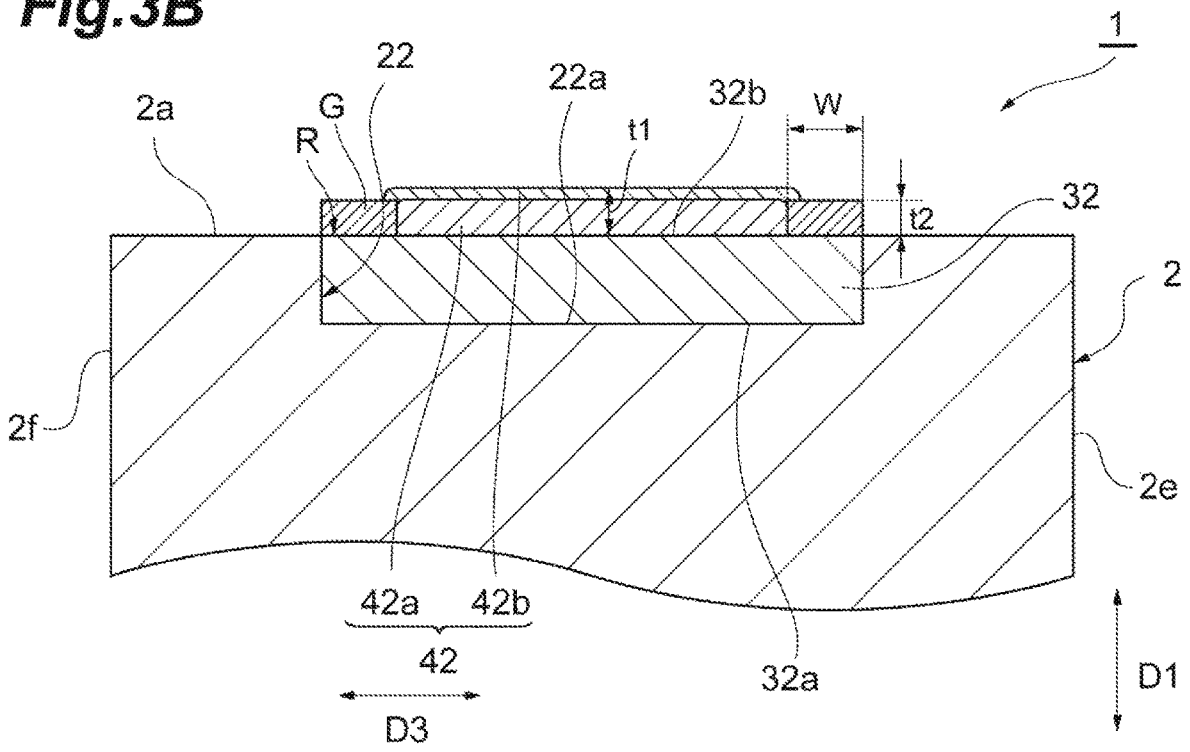

With reference to FIGS. 1, 2, 3A, and 3B, a laminated coil component according to an embodiment is described. FIG. 1 is a perspective view of the laminated coil component according to the embodiment. FIG. 2 is an exploded perspective view of the laminated coil component in FIG. 1. FIG. 3A is a cross-sectional view taken along line IIIa-IIIa of FIG. 1 FIG. 3B is a cross-sectional view taken along line IIIb-IIIb of FIG. 1.

A laminated coil component 1 according to the embodiment includes an element body 2, a pair of conductors 3, a pair of plating layers 4, a pair of glass layers G, a plurality of coil conductors 5*c*, 5*d*, 5*e*, and 5*f*, and connecting conductors 6 and 7. In FIG. 2, illustration of the plating layers 4 and the glass layers G is omitted.

The element body 2 has a rectangular parallelepiped shape. The rectangular parallelepiped shape includes a rectangular parallelepiped shape in which the corner portions and the ridge portions are chamfered, and a rectangular parallelepiped shape in which the corner portions and the ridge portions are rounded. The element body 2 has end faces 2*a* and 2*b*, and side faces 2*c*, 2*d*, 2*e*, and 2*f*. The end faces 2*a* and 2*b* are opposed to each other. The side faces 2*c* and 2*d* are opposed to each other. The side faces 2*e* and 2*f* are opposed to each other. In the following description, it is assumed that the opposing direction of the end faces 2*a* and 2*b* is a direction D1, that the opposing direction of the side faces 2*c* and 2*d* is a direction D2, and that the opposing direction of the side faces 2*e* and 2*f* is a direction D3. The direction D1, the direction D2, and the direction D3 are substantially orthogonal to each other.

The end faces 2*a* and 2*b* extend in the direction D2 in such a way as to connect the side faces 2*c* and 2*d*. The end faces 2*a* and 2*b* also extend in the direction D3 in such a way as to connect the side faces 2*e* and 2*f*. The side faces 2*c* and 2*d* extend in the direction D1 in such a way as to connect the end faces 2*a* and 2*b*. The side faces 2*c* and 2*d* also extend in the direction D3 in such a way as to connect the side faces 2*e* and 2*f*. The side faces 2*e* and 2*f* extend in the direction D2 in such a way as to connect the side faces 2*c* and 2*d*. The side faces 2*e* and 2*f* also extend in the direction D1 in such a way as to connect the end faces 2*a* and 2*b*.

The side face 2*c* is a mounting surface and is opposed to another electronic device, which is not shown, (for example, a circuit substrate or an electronic component) when, for example, the laminated coil component 1 is mounted on the electronic device. The end faces 2*a* and 2*b* are faces continuing from the mounting surface (that is, the side face 2*c*).

The length of the element body 2 in the direction D1 is longer than the length of the element body 2 in the direction D2 and the length of the element body 2 in the direction D3. The length of the element body 2 in the direction D2 and the length of the element body 2 in the direction D3 are equivalent to each other. That is, in the present embodiment, the end faces 2*a* and 2*b* each have a square shape, and the side faces 2*c*, 2*d*, 2*e*, and 2*f* each have a rectangular shape. The length of the element body 2 in the direction D1 may be equivalent to the length of the element body 2 in the direction D2 and to the length of the element body 2 in the direction D3, or may be shorter than these lengths. The length of the element body 2 in the direction D2 and the length of the element body 2 in the direction D3 may be different from each other.

In the present embodiment, the term "equivalent" may include, in addition to being equal, a value including a slight difference or a manufacturing error in a preset range. For example, if a plurality of values is included within the range of ±5% of the average value of the values, the values are defined to be equivalent.

The element body 2 is provided with a pair of recesses 21 and a pair of recesses 22. One recess 21 and one recess 22 are continuously provided and correspond to one conductor 3. The other recess 21 and the other recess 22 are continuously provided and correspond to the other conductor 3. The recesses 21 and 22 have, for example, the same shape. The pair of recesses 21 and the pair of recesses 22 are provided in such a way as to be separated from the side faces 2*d*, 2*e*, and 2*f*. The pair of recesses 21 is provided in such a way as to be separated from each other in the direction D1.

The one recess 21 is provided on the side face 2*c* in such a way as to be adjacent to the end face 2*a*. The one recess 21 is recessed toward the side face 2*d*. The other recess 21 is provided on the side face 2*c* in such a way as to be adjacent to the end face 2*b*. The other recess 21 is recessed toward the side face 2*d*. Each recess 21 have a bottom face 21*a*. The bottom face 21*a* has, for example, a rectangular shape. The one recess 22 is provided on the end face 2*a* in such a way as to be adjacent to the side face 2*c*. The one recess 22 is recessed toward the end face 2*b*. The other recess 22 is provided on the end face 2*b* in such a way as to be adjacent to the side face 2*c*. The other recess 22 is recessed toward the end face 2*a*. Each recess 22 has a bottom face 22*a*. The bottom face 22*a* has, for example, a rectangular shape.

The element body 2 is constituted by laminating a plurality of element-body layers 12*a* to 12*f* in the direction D3. A specific laminated structure will be described later. In the actual element body 2, the element-body layers 12*a* to 12*f* are integrated in such a way that no boundaries between the layers cannot be visually recognized. The element-body layers 12*a* to 12*f* includes, for example, a magnetic material (Ni—Cu—Zn-based ferrite material, Ni—Cu—Zn—Mg-based ferrite material, Ni—Cu-based ferrite material, or the like). The magnetic material forming the element-body layers 12*a* to 12*f* may contain Fe alloy or the like. The element-body layers 12*a* to 12*f* may include a non-magnetic material (a glass ceramic material, a dielectric material, or the like). The element body 2 contains a glass component.

Each conductor 3 is provided on the element body 2. Each conductor 3 is disposed in the recesses 21 and 22. Specifically, the one conductor 3 is disposed in the one recess 21 and the one recess 22. The other conductor 3 is disposed in the other recess 21 and the other recess 22.

The pair of conductors 3 is separated from each other in the direction D1. The pair of conductors 3 has, for example, the same shape. Each conductor 3 has, for example, an L-shaped cross section. It can be also described that each conductor 3 has, for example, an L shape when viewed from the direction D3. Each conductor 3 has integrally formed conductor portions 31 and 32. The conductor portions 31 and 32 each have a substantially rectangular plate shape. The conductor portions 31 and 32 have, for example, the same shape.

Each conductor 3 is constituted by laminating, in the direction D3, a plurality of conductor layers 13 having an L shape when viewed from the direction D3. That is, the laminating direction of the conductor layers 13 is the direction D3. In the actual conductor 3, the conductor layers 13 are integrated in such a way that no boundaries between the layers cannot be visually recognized.

The conductor portions 31 are disposed on the side face 2*c* which is the mounting surface. Each conductor portion 31 is disposed in the recess 21. As particularly shown in FIG. 3A, each conductor portion 31 has a first face 31*a* and a second face 31*b*. The first face 31*a* is opposed to the bottom face 21*a* in the direction D2. The second face 31*b* is opposed to the first face 31*a* in the direction D2.

The conductor portions 32 are disposed on the end faces 2*a* and 2*b*. Each conductor portion 32 is disposed in the recess 22. As particularly shown in FIG. 3B, the conductor portion 32 has a first face 32*a* and a second face 32*b*. The first face 32*a* is opposed to the bottom face 22*a* in the direction D1. The second face 32*b* is opposed to the first face 32*a* in the direction D1.

Each plating layer 4 is provided on the conductor 3. Each plating layer 4 has a plated portion 41 provided on the second face 31*b* and a plated portion 42 provided on the second face 32*b*. Each plating layer 4 is formed by electrolytic plating or electroless plating. The plated portion 41 is formed in such a way as to have a constant thickness over the entire surface of the second face 31*b*. The plated portion 42 is formed in such a way as to have a constant thickness over the entire surface of the second face 32*b*.

Each plating layer 4 contains, for example, nickel (Ni), gold (Au), tin (Sn) or the like. Each plating layer 4 has an Ni plating layer 4*a* and an Au plating layer 4*b*. The Ni plating layer 4*a* contains, for example, Ni and covers the second faces 31*b* and 32*b*. The Au plating layer 4*b* contains Au and covers the Ni plating layer 4*a*. Since each plating layer 4 has the Ni plating layer 4*a* and the Au plating layer 4*b*, the electric resistance of the plating layer 4 can be reduced. The thickness t1 of each plating layer 4 is the sum (total thickness) of the films forming the plating layer 4. The thickness t1 is, for example, the sum of the thickness of the Ni plating layer 4*a* and the thickness of the Au plating layer 4*b*. The thickness of the Ni plating layer 4*a* is, for example, 6 μm. The thickness of the Au plating layer 4*b* is, for example, 0.1 μm.

Each glass layer G includes, for example, the same component as the glass component contained in the element body 2. Each glass layer G is provided on the conductor 3 along the outer edge of the plating layer 4.

Specifically, one glass layer G provided on the one conductor 3 is provided on the region along the outer edges on the end face 2*b* side, the side face 2*e* side, and the side face 2*f* side of the second face 31*b*, and the region along the outer edges on the side face 2*d* side, the side face 2*e* side, and the side face 2*f* side of the second face 32*b*. The one glass layer G is, for example, continuously provided on these regions, and has a frame shape. The one glass layers G may have a discontinuous frame shape.

The other glass layer G provided on the other conductor 3 is provided on the region along the outer edges on the end face 2*a* side, the side face 2*e* side, and the side face 2*f* side of the second face 31*b*, and the region along the outer edges on the side face 2*d* side, the side face 2*e* side, and the side face 2*f* side of the second face 32*b*. The other glass layers G is, for example, continuously provided on these regions, and has a frame shape. The other glass layers G may have a discontinuous frame shape.

In this manner, each glass layer G has a frame shape and is provided in such a way as to surround the plating layer 4 on the conductor 3. In each conductor 3, the width w of the region R (overlapping with the glass layer G when viewed from the thickness direction of the conductor 3) at which the glass layer G is provided is equal to or greater than the thickness t1 of the plating layer 4. In the present embodiment, the thickness t2 of the glass layer G is thinner than the thickness t1 of the plating layer 4. The width w is equal to the width of the glass layer G. That is, the glass layer G does not protrude from the conductor 3. The outer edge of the glass layer G and the outer edge of the conductor 3 are aligned with each other. The thickness t2 of the glass layer G is thinner than the thickness t1 of the plating layer 4. The plating layer 4 is provided on the glass layer G.

The width w may be narrower than the width of the glass layer G. That is, the glass layer G may protrude from the conductor 3. As a result, the outer edge of the glass layer G may be positioned outside the outer edge of the conductor 3. The thickness t2 may be equal to or greater than the thickness t1. The plating layer 4 may not be provided on the glass layer G.

The coil conductors 5*c*, 5*d*, 5*e*, and 5*f* are connected to each other to form a coil 10 in the element body 2. The coil axis of the coil 10 is provided along the direction D3. The coil conductors 5*c*, 5*d*, 5*e*, and 5*f* are disposed in such a way as to at least partially overlap each other when viewed from the direction D3. The coil conductors 5*c*, 5*d*, 5*e*, and 5*f* are disposed in such a way as to be separated from the end faces 2*a* and 2*b* and the side faces 2*c*, 2*d*, 2*e*, and 2*f*.

The coil conductor 5*c* includes a plurality of coil conductor layers 15*c* laminated in the direction D3. The coil conductor 5*d* includes a plurality of coil conductor layers 15*d* laminated in the direction D3. The coil conductor 5*e* includes a plurality of coil conductor layers 15*e* laminated in the direction D3. The coil conductor 5*f* includes a plurality of coil conductor layers 15*f* laminated in the direction D3. The plurality of the coil conductor layers 15*c* are disposed in such way as to entirely overlap each other when viewed from the direction D3. The plurality of the coil conductor layers 15*d* are disposed in such way as to entirely overlap each other when viewed from the direction D3. The plurality of the coil conductor layers 15*e* are disposed in such way as to entirely overlap each other when viewed from the direction D3. The plurality of the coil conductor layers 15*f* are disposed in such way as to entirely overlap each other when viewed from the direction D3. The coil conductor 5*c* may be constituted by a coil conductor layer 15*c*. The coil conductor 5*d* may be constituted by a coil conductor layer 15*d*. The coil conductor 5*e* may be constituted by a coil conductor layer 15*e*. The coil conductor 5*f* may be constituted by a coil conductor layer 15*f*. FIG. 2 shows one each of the plurality of the coil conductor layers 15*c*, the plurality of the coil conductor layers 15*d*, the plurality of the coil conductor layers 15*e*, and the plurality of the coil conductor layers 15*f*. In the actual coil conductor 5*c*, the plurality of the coil conductor layers 15*c* are integrated in such a way that no boundaries between the layers can be visually recognized. In the actual coil conductor 5*d*, the plurality of the coil conductor layers 15*d* are integrated in such a way that no boundaries between the layers can be visually recognized. In the actual coil conductor 5*e*, the plurality of the coil conductor layers 15*e* are integrated in such a way that no boundaries between the layers can be visually recognized. In the actual coil conductor 5*f*, the plurality of the coil conductor layers 15*f* are integrated in such a way that no boundaries between the layers can be visually recognized.

The connecting conductor 6 extends along the direction D1. The connecting conductor 6 is connected to the coil conductor 5*c* and the other conductor portion 32. The connecting conductor 7 extends along the direction D1. The connecting conductor 7 is connected to the coil conductor 5*f* and the one conductor portion 32. The connecting conductor 6 includes a plurality of connecting conductor layers 16 laminated in the direction D3. The connecting conductor 7 includes a plurality of connecting conductor layers 17 laminated in the direction D3. In FIG. 2, one of the plurality of the connecting conductor layers 16 and one of the plurality of the connecting conductor layers 17 are shown. In the actual connecting conductor 6, the plurality of the connecting conductor layers 16 are integrated in such a way that no boundaries between the layers can be visually recognized. In the actual connecting conductor 7, the plurality of the connecting conductor layers 17 are integrated in such a way that no boundaries between the layers can be visually recognized.

The conductor layers 13, the coil conductor layers 15*c*, 15*d*, 15*e*, and 15*f*, and the connecting conductor layers 16 and 17 includes a conductive material (for example, Ag or Pd). Each layer may include the same material or different materials. Each layer has a substantially rectangular cross section.

The laminated coil component 1 has layers La, Lb, Lc, Ld, Le, and Lf. For example, the laminated coil component 1 is constituted by laminating, from the side face 2*f* side, two layers La, one layer Lb, three layers Lc, three layers Ld, three layers Le, three layers Lf, one layer Lb, and two layers La, in this order. FIG. 2 shows one of the three layers but not the other two layers for each of the three layers Lc, the three layers Ld, the three layers Le, and the three layers Lf.

The layer La is constituted by the element-body layer 12*a*.

The layer Lb is constituted by combining the element-body layer 12*b* and a pair of conductor layers 13 with each other. The element-body layer 12*b* is provided with a defect portion Rb. The defect portion Rb has shapes corresponding to the respective shapes of the pair of conductor layers 13. The pair of conductor layers 13 is fitted into the defect portion Rb. The element-body layer 12*b* and the pair of conductor layers 13 have mutually complementary relationship as a whole.

The layer Lc is constituted by combining the element-body layer 12*c*, a pair of conductor layers 13, and the coil conductor layer 15*c* with each other. The element-body layer 12*c* is provided with a defect portion Rc. The defect portion Rc has shapes corresponding to the respective shapes of the pair of conductor layers 13, the coil conductor layer 15*c*, and the connecting conductor layer 16. The pair of the conductor layers 13, the coil conductor layer 15*c*, and the connecting conductor layer 16 are fitted into the defect portion Rc. The element-body layer 12*c*, the pair of conductor layers 13, the coil conductor layer 15*c*, and the connecting conductor layer 16 have mutually complementary relationship as a whole.

The layer Ld is constituted by combining the element-body layer 12*d*, a pair of conductor layers 13, and the coil conductor layer 15*d* with each other. The element-body layer 12*d* is provided with a defect portion Rd. The defect portion Rd has shapes corresponding to the respective shapes of the pair of conductor layers 13, and the coil conductor layer 15*d*. The pair of conductor layers 13, and the coil conductor layer 15*d* are fitted into the defect portion Rd. The element-body layer 12*d*, the pair of conductor layers 13, and the coil conductor layer 15*d* have mutually complementary relationship as a whole.

The layer Le is constituted by combining the element-body layer 12*e*, a pair of conductor layers 13, and the coil conductor layer 15*e* with each other. The element-body layer 12*e* is provided with a defect portion Re. The defect portion Re has shapes corresponding to the respective shapes of the pair of conductor layers 13, and the coil conductor layer 15*e*. The pair of conductor layers 13, and the coil conductor layer 15*e* are fitted into the defect portion Re. The element-body layer 12*e*, the pair of conductor layers 13, and the coil conductor layer 15*e* have mutually complementary relationship as a whole.

The layer Lf is constituted by combining the element-body layer 12*f*, a pair of conductor layers 13, the coil conductor layer 15*f*, and the connecting conductor layer 17 with each other. The element-body layer 12*f* is provided with a defect portion Rf. The defect portion Rf has shapes corresponding to the respective shapes of the pair of conductor layers 13, the coil conductor layer 15*f*, and the connecting conductor layer 17. The pair of the conductor layers 13, the coil conductor layer 15*f*, and the connecting conductor layer 17 are fitted into the defect portion Rf. The element-body layer 12*f* the pair of conductor layers 13, the coil conductor layer 15*f*, and the connecting conductor layer 17 have mutually complementary relationship as a whole.

The defect portions Rb, Rc, Rd, Re, and Rf are integrated to constitute the pair of recesses 21 and pair of recesses 22. The widths of the defect portions Rb, Rc, Rd, Re, and Rf (hereinafter, the width of the defect portion) are basically set in such a way as to be wider than the those of the conductor layers 13, the coil conductor layers 15*c*, 15*d*, 15*e*, and 15*f*, and the connecting conductor layers 16 and 17 (hereinafter, the width of the conductor portion). The width of the defect portion may be intentionally set in such a way as to be narrower than the width of the conductor portion in order for the element-body layers 12*b*, 12*c*, 12*d*, 12*e*, and 12*f* to adhere to the conductor layers 13, the coil conductor layers 15*c*, 15*d*, 15*e*, and 15*f*, and the connecting conductor layers 16 and 17 more firmly. The value obtained by subtracting the width of the conductor portion from the width of the defect portion is preferably, for example, −3 μm or more and 10 μm or less, and more preferably 0 μm or more and 10 μm or less.

An example of a method for manufacturing the laminated coil component 1 according to the embodiment is described.

First, an element-body paste containing the constituent material of the element-body layers 12*a* to 12*f* and a photosensitive material is applied on a substrate (for example, a PET film). An element-body forming layer is thereby formed. The photosensitive material contained in the element-body paste may be either a negative type or a positive type, and a known photosensitive material can be used. Then, the element-body forming layer is exposed and developed by, for example, a photolithography method using a Cr mask. An element-body pattern from which a shape corresponding to the shape of a conductor forming layer to be described later is removed is thereby formed on the substrate. The element-body pattern is a layer to be each of the element-body layers 12*b*, 12*c*, 12*d*, 12*e*, and 12*f* after heat treatment. That is, the element-body pattern provided with defect portions to be the defect portions Rb, Rc, Rd, Re, and Rf is formed. Note that, the "photolithography method" in the present embodiment is only required to be a method for forming a desired pattern by exposing and developing a layer to be patterned containing a photosensitive material, and is not limited to the type of mask or the like.

On the other hand, a conductor paste containing the constituent materials of the above conductor layer 13, the coil conductor layers 15*c*, 15*d*, 15*e*, and 15*f*, and the connecting conductor layers 16 and 17, and a photosensitive material is applied on a substrate (for example, a PET film). A conductor forming layer is thereby formed. The photosensitive material contained in the conductor paste may be either a negative type or a positive type, and a known photosensitive material can be used. Then, the conductor forming layer is exposed and developed by, for example, a photolithography method using a Cr mask. A conductor pattern is thereby formed on the substrate. The conductor pattern is a layer to be each of the conductor layer 13, the coil conductor layers 15*c*, 15*d*, 15*e*, and 15*f*, and the connecting conductor layers 16 and 17 after the heat treatment.

Then, the element-body forming layer is transferred from the substrate onto a supporting body. In the present embodiment, the step of transferring the element-body forming layer is repeated twice. Two element-body forming layers are thereby laminated on the supporting body. These element-body forming layer are layers to be the layer La after the heat treatment.

Then, the conductor pattern and the element-body pattern are repeatedly transferred onto the supporting body. The conductor patterns and the element-body patterns are thereby laminated in the direction D3. Specifically, first, the conductor pattern is transferred from the substrate onto the element-body forming layer. Next, the element-body pattern is transferred from the substrate onto the element-body forming layer. The conductor pattern is combined with the defect portion of the element-body pattern, and the element-body pattern and the conductor pattern are in the same layer on the element-body forming layer. The step of transferring the conductor pattern and element-body pattern is further repeated. The conductor pattern and the element-body pattern are thereby laminated in a state of being combined with each other. The layers to be the layers Lb, Lc, Ld, Le, and Lf after the heat treatment are thereby laminated.

Then, the element-body forming layer is transferred from the substrate onto the layers laminated in the steps of transferring the conductor pattern and the element-body pattern. In the present embodiment, the step of transferring the element-body forming layer is repeated twice. Two element-body forming layers are thereby laminated on the layer. These element-body forming layer are layers to be the layer La after the heat treatment.

As described above, the laminate to be the portion other than the plating layers 4 and the glass layers G of the laminated coil component 1 after the heat treatment is formed on the supporting body as an intermediate body before the laminated coil component 1. Then, the obtained laminate is cut into a predetermined size. Thereafter, the cut laminate is subjected to binder removal treatment, and then subjected to the heat treatment. The temperature of the heat treatment is, for example, about 850 to 900° C. By the heat treatment, each glass layer G is formed on the second faces 31*b* and 32*b* of the conductor 3. Then, electrolytic plating or electroless plating is performed to form each plating layer 4 on the second faces 31*b* and 32*b* of the conductor 3. The laminated coil component 1 is thereby obtained.

Figure 4A:
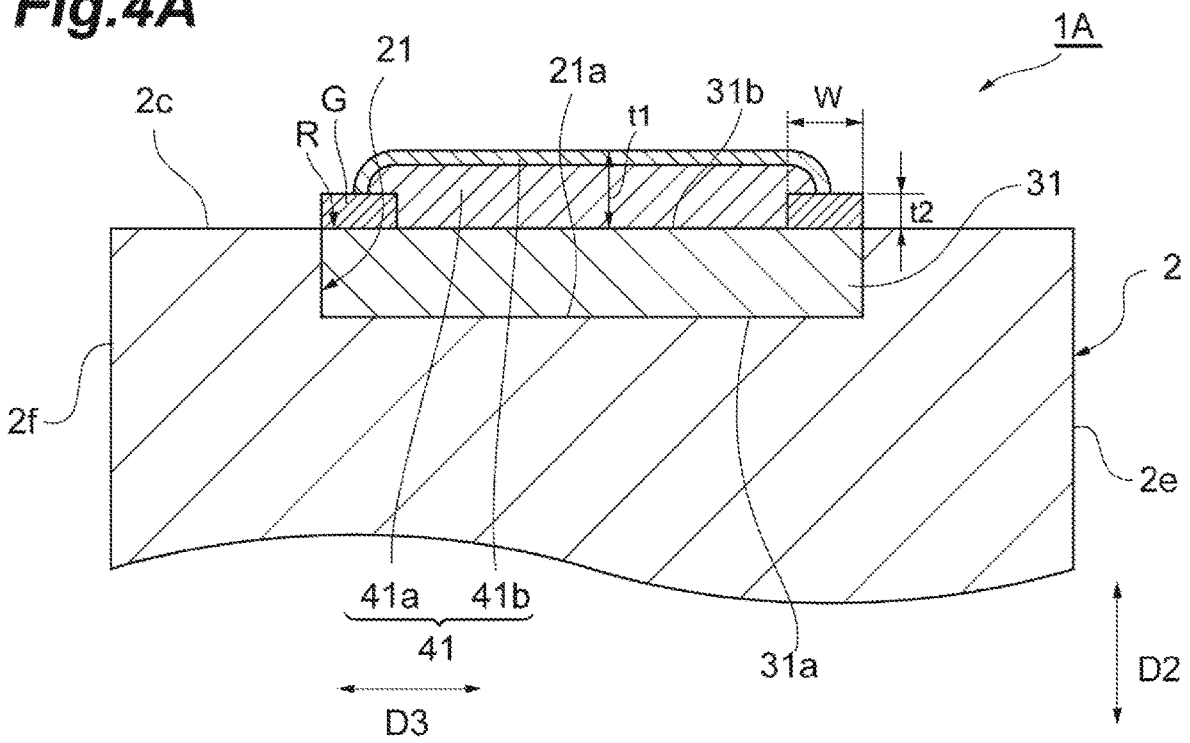
FIGS. 4A and 4B are cross-sectional views of the laminated coil component according to a modified example.
Figure 4B:
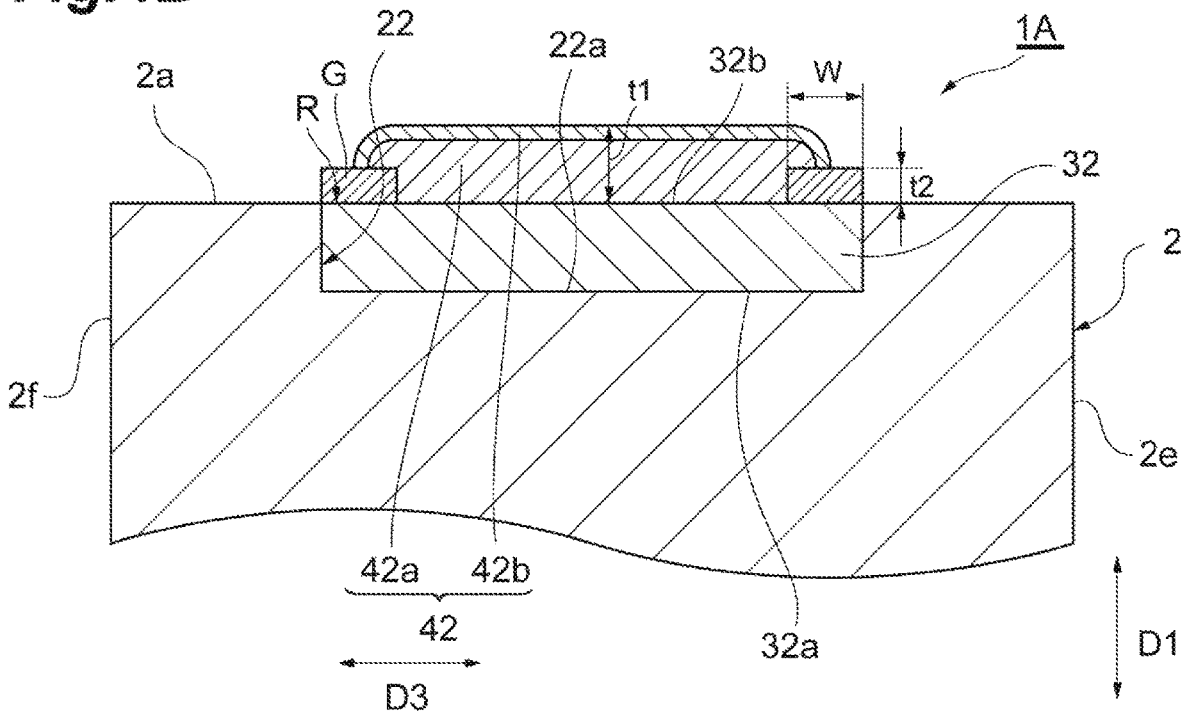

FIGS. 4A and 4B are cross-sectional views of a laminated coil component according to a modified example. A laminated coil component 1A according to the modified example is different from the laminated coil component 1 in that a plating layer 4 is thickened. In electrolytic plating or electroless plating, as long as the plating layer 4 is formed in such a way that the thickness t1 of the plating layer 4 does not exceed the width w of the region R, the range in which the plating layer 4 is formed can be kept on the conductor 3.

Figure 5A:
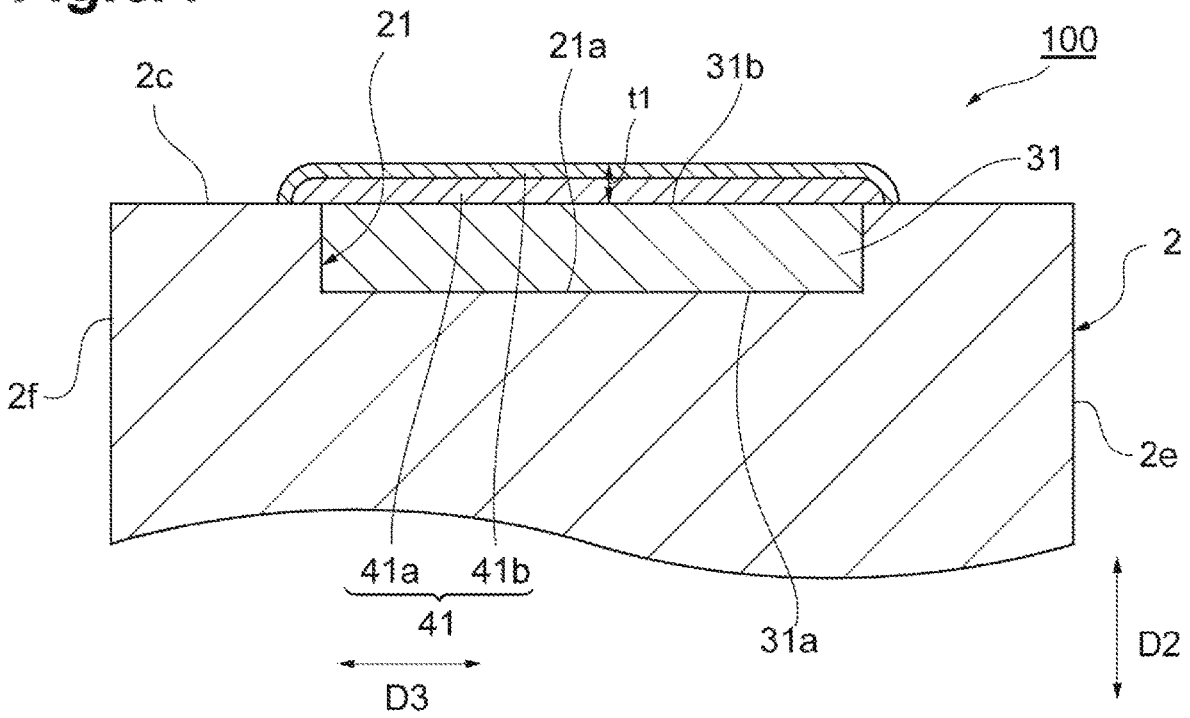
FIGS. 5A and 5B are cross-sectional views of the laminated coil component according to a first comparative example and a second comparative example.
Figure 5B:
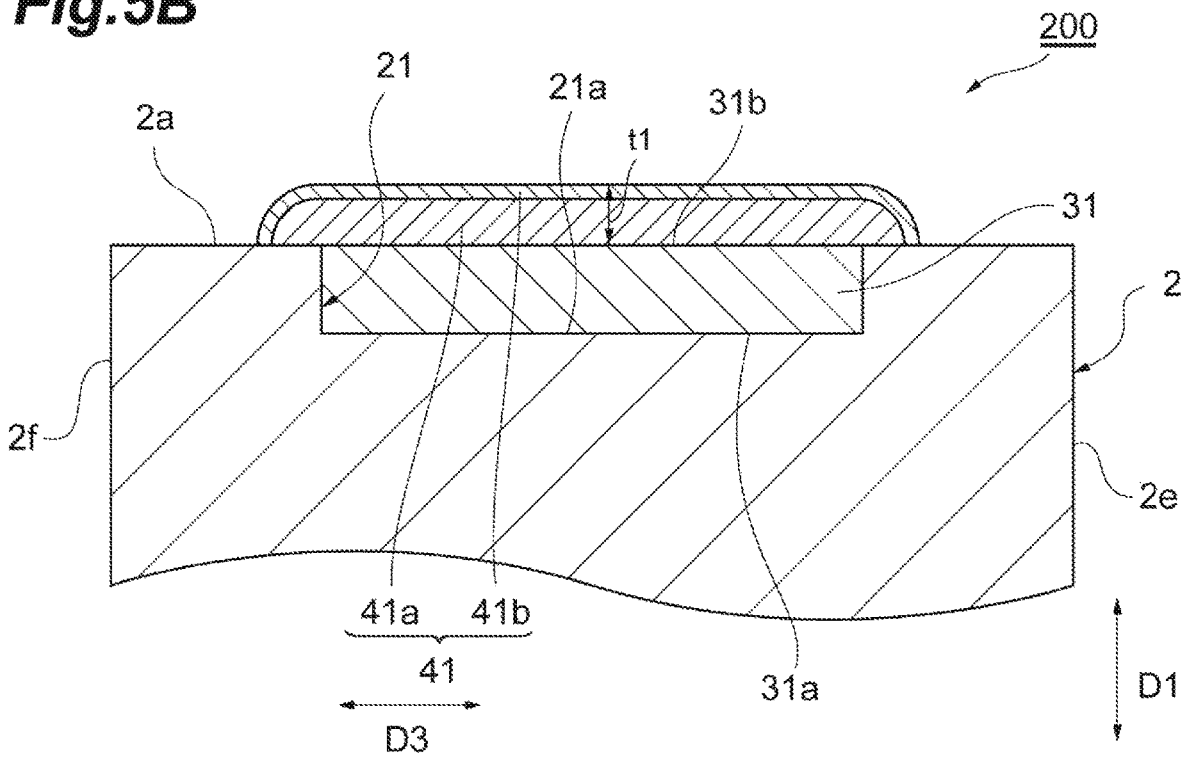

FIGS. 5A and 5B are cross-sectional views of laminated coil components according to a first comparative example and a second comparative example. A laminated coil component 100 according to the first comparative example shown in FIG. 5A is different from the laminated coil component 1 mainly in that it does not have a glass layer G. A sectional view of the laminated coil component 100 on the conductor portion 32 side is omitted. A laminated coil component 200 according to the second comparative example shown in FIG. 5B is different from the laminated coil component 1A mainly in that it does not have a glass layer G. A sectional view of the laminated coil component 200 on the conductor portion 32 side is omitted.

As described above, since each of the laminated coil components 100 and 200 does not have the glass layer G, plating elongation can occur if a plating layer 4 formed by electrolytic plating or electroless plating. Thus, when the laminated coil component 100 or 200 is mounted on another electronic device by, for example, solder joint, a short circuit between the conductors 3 can occur.

In contrast, in each of the laminated coil components 1 and 1A, since the glass layer G is provided on the conductor 3 along the outer edge of the plating layer 4, plating elongation is suppressed. In particular, in the conductor 3, the width w of the region R at which the glass layer G is provided is equal to or greater than the thickness t1 of the plating layer 4. Thus, when the plating layer 4 is formed by the electrolytic plating or electroless plating, the plating layer 4 does not protrude from the conductor 3. Accordingly, it is possible to reliably suppress the plating elongation.

For example, by providing the glass layer G along the outer edges of the second faces 31*b* and 32*b* of the conductor 3 not on the second faces 31*b* and 32*b* but on the end faces 2*a* and 2*b* and the side face 2*c*, it is also possible to suppress the plating elongation. However, in such a laminated coil component, the thickness t2 of the glass layer G needs to be equal to or greater than the thickness t1 of the plating layer 4. That is, the plating layer 4 cannot be protruded from the glass layer G. For this reason, when such a laminated coil component is mounted on another electrical device, the glass layer G may obstruct the electrical connection with the electrical device. The glass layer G further needs to be thickened, it is difficult to manufacture such a laminated coil component. In contrast, in each of the laminated coil components 1 and 1A, the glass layer G is provided on the second faces 31*b* and 32*b*. Thus, the thickness t2 of the glass layer G does not need to be equal to or greater than the thickness t1 of the plating layer 4. That is, the plating layer 4 can be protruded from the glass layer G. Thus, when the laminated coil component 1 or 1A is mounted on another electric device, electrical connection with the electric device is facilitated. Furthermore, since the glass layer G does not need to be thickened, it is easy to manufacture the laminated coil component 1 or 1A.

The plating layer 4 is also provided on the glass layer G. In this manner, since the plating layer 4 is provided in a wide range, it is possible to suppress what is called chip standing (or tombstone). The chip standing is a phenomenon in which the laminated coil component 1 stands when the laminated coil component 1 is mounted on another electronic device. As described above, it is possible to stably mount the laminated coil component 1, and to improve the mountability.

Each glass layer G includes, for example, the same component as the glass component contained in the element body 2. Thus, the possibility that the component of the glass layer G adversely affects the characteristics of the laminated coil component 1 or 1A can be reduced as compared with the case in which the glass layer G includes a glass component that is not contained in the element body 2. In manufacturing the laminated coil component 1, when the intermediate body including the element body 2 and the conductor 3 is obtained by the heat treatment, the glass component of the element body 2 reaches the upper face of the conductor 3, whereby the glass layer G is simultaneously formed. In this manner, the step of forming the glass layer G does not need to be separately provided, and it is possible to improve the productivity. The glass layer G may include, for example, a different component from the glass component contained in the element body 2.

The element body 2 is provided with the recesses 21 and 22, and the conductor 3 is disposed in the recesses 21 and 22. Thus, the distance between the end faces 2*a* and 2*b* or the side faces 2*c*, 2*d*, 2*e*, and 2*f* of the element body 2 and the second face 31*b* and 32*b* of the conductor 3 is shortened as compared with the case in which the conductor 3 is provided on the end faces 2*a* and 2*b* or the side faces 2*c*, 2*d*, 2*e*, and 2*f* of the element body 2. Thus, in manufacturing the laminated coil component 1, the glass component of the element body 2 easily reaches the upper face of the conductor 3 at the time of the heat treatment, and it is possible to easily form the glass layer G on the conductor 3.

The element body 2 has the side face 2*c* which is the mounting surface. The conductor 3 has the conductor portion 31 disposed on the side face 2*c*. Thus, when the laminated coil component 1 is mounted on another electronic device, it is possible to easily achieve the electrical connection between the conductor portion 31 and the electronic device. The element body 2 further has the end faces 2*a* and 2*b* continuing from the side face 2*c*. The conductor 3 further has the conductor portion 32 provided integrally with the conductor portion 31 and disposed on the end face 2*a* or 2*b*. For this reason, when the laminated coil component 1 is mounted on another electronic device by, for example, solder joint, solder is provided not only on the side face 2*c* but also on the end faces 2*a* and 2*b*. Accordingly, it is possible to increase mounting strength.

The present invention is not limited to the above embodiment, and various modifications can be made.

Each of the laminated coil components 1 and 1A may further have a core portion inside the coil 10 when viewed from the direction D3. The core portion may be hollow. That is, each of the laminated coil components 1 and 1A may be an air-core coil. The core portion may be solid and include, for example, a magnetic material different from the constituent material of the element body 2. The core portion may penetrate the element body 2 in the direction D3. The core portion may be covered with the element body 2 at both end portions in the direction D3. Each of the laminated coil components 1 and 1A may further have spacers disposed between the coil conductors 5*c*, 5*d*, 5*e*, and 5*f* in the direction D3. In this case, the spacer may include, for example, a magnetic material or a non-magnetic material different from the constituent material of the element body 2.

In each of the laminated coil components 1 and 1A, the conductor 3 is only required to have either the conductor portion 31 or 32. In this case, the element body 2 may be provided with either the recess 21 or 22 in correspondence with the conductor portion 31 or 32.

In each of the laminated coil components 1 and 1A, the conductor 3 may be provided on the end faces 2*a* and 2*b* or on the side faces 2*c*, 2*d*, 2*e*, and 2*f*. The conductive material constituting the conductor 3 in this case may be, for example, Cu from the viewpoint of adhesion to the element body 2, cost, and the like, or may be the same material as the conductive material (for example, Ag or Pd) constituting the connecting conductor layers 16 and 17 from the viewpoint of connectivity with the connecting conductor layers 16 and 17, and the like. In the method of manufacturing each of the laminated coil components 1 and 1A in this case, when the conductor pattern is formed, the conductor patterns are formed as the layers to be the coil conductor layers 15*c*, 15*d*, 15*e*, and 15*f* and the connecting conductor layers 16 and 17 after the heat treatment. Then, after the element-body forming layer, the element-body pattern, and the conductor pattern are laminated, the heat treatment is performed to obtain a laminate to be a portion other than the conductor 3, the plating layer 4, and the glass layer G of the laminated coil component 1. Then, a conductive paste containing the constituent material of the conductor 3 is applied onto the outer surface of the laminate. The conductor paste can be applied by a dipping method, a printing method, a transfer method, or the like. A desired heat treatment is performed to the laminate to which the conductor paste is applied in order to bake the conductor paste on the laminate. The conductor paste is baked by, for example, being heated at a temperature of 600 to 800° C. for a predetermined time. The glass layer G is thereby formed on the conductor 3. Then, the plating layer 4 is formed on the conductor 3 by electrolytic plating or electroless plating. As a result, the laminated coil component 1 or 1A is obtained.

In the embodiment described above, the laminated coil component 1 has been described as an example of an electronic component, but the present invention is not limited to this, and can be applied to other electronic components such as multilayer ceramic capacitors, laminated varistors, laminated piezoelectric actuators, laminated thermistors, and laminated composite components.

What is claimed is:

1. An electronic component comprising:
an element body;
a conductor provided on the element body;
a plating layer provided on the conductor; and
a glass layer provided on the conductor along an outer edge of the plating layer, with the conductor sandwiched between the glass layer and the element body, a first portion of the glass layer being exposed from the plating layer.

2. The electronic component according to claim 1, wherein, in the conductor, a width of a region at which the glass layer is provided is equal to or greater than a thickness of the plating layer.

3. The electronic component according to claim 1, wherein the plating layer is provided on the glass layer.

4. The electronic component according to claim 1, wherein
the element body contains a glass component, and
the glass layer includes the same component as the glass component.

5. The electronic component according to claim 1, wherein
the element body is provided with a recess, and
the conductor is disposed in the recess.

6. The electronic component according to claim 1, wherein
the element body has a mounting surface, and
the conductor has a first conductor portion disposed on the mounting surface.

7. The electronic component according to claim 6, wherein
the element body further has an end face continuing from the mounting surface,
the conductor further has a second conductor portion disposed on the end face and has an L-shaped cross section, and
the second conductor portion is provided integrally with the first conductor portion.

8. The electronic component according to claim 1, wherein
a part of the outer edge of the plating having is provided to cover a second portion of the glass layer, with the second portion of the glass layer being sandwiched between the part of the outer edge of the plating layer and the conductor.

9. An electronic component comprising:
an element body;
a conductor provided on the element body;
a plating layer provided on the conductor; and
an insulation layer that is made of glass and provided on the conductor along an outer edge of the plating layer, with the conductor sandwiched between the glass layer and the element body.

10. The electronic component according to claim 9, wherein the insulation layer is made of glass only.

11. An electronic component comprising:
an element body;
a conductor provided on the element body;
a plating layer provided on the conductor, the plating layer having two sublayers made of different materials; and
a glass layer provided on the conductor along an outer edge of the plating layer, with the conductor sandwiched between the glass layer and the element body, the glass layer being in direct contact with both sub-layers of the plating layer.

* * * * *